US006684470B1

(12) United States Patent
Joux

(10) Patent No.: US 6,684,470 B1
(45) Date of Patent: Feb. 3, 2004

(54) ELECTROPORTABLE DEVICE FOR PLACING CLINCH-ON NUTS OR BREAK-OFF STEM BLIND RIVETS

(76) Inventor: Jean-Claude Joux, 134, chemin des Breguieres, F-06140 Tourettes sur Loup (FR)

( * ) Notice: Subject to any disclaimer, the term of this patent is extended or adjusted under 35 U.S.C. 154(b) by 0 days.

(21) Appl. No.: 09/719,630

(22) PCT Filed: May 11, 1999

(86) PCT No.: PCT/FR99/01112

§ 371 (c)(1),
(2), (4) Date: Dec. 15, 2000

(87) PCT Pub. No.: WO99/65630

PCT Pub. Date: Dec. 23, 1999

(30) Foreign Application Priority Data

Jun. 15, 1998 (FR) ..... 98 07546

(51) Int. Cl.[7] ..... B21J 15/26

(52) U.S. Cl. ..... 29/243.521; 29/243.526; 29/243.53; 72/391.6; 72/391.8

(58) Field of Search ..... 72/391.6, 391.8, 72/453.17, 114; 29/243.521, 243.522, 243.523, 243.524, 243.525, 243.526; 81/177 A, 177.8

(56) References Cited

U.S. PATENT DOCUMENTS

| | | | | | |
|---|---|---|---|---|---|
| 2,283,665 | A | | 5/1942 | Cadden | |
| 2,406,949 | A | * | 9/1946 | Huck | 72/391.8 |
| 3,359,777 | A | * | 12/1967 | Lee | 72/391.6 |
| 3,822,595 | A | * | 7/1974 | Elflein | 72/114 |
| 3,961,517 | A | * | 6/1976 | DiMaio | 29/243.529 |
| 4,574,612 | A | | 3/1986 | Tanikawa | |
| 4,836,003 | A | * | 6/1989 | Blake | 72/391.8 |
| 5,035,353 | A | * | 7/1991 | Smart et al. | 29/243.525 |
| 5,315,744 | A | * | 5/1994 | Denham et al. | 29/243.523 |
| 5,327,790 | A | | 7/1994 | Levin et al. | |
| 5,473,805 | A | * | 12/1995 | Wille | 29/243.526 |
| 5,600,878 | A | * | 2/1997 | Byrne et al. | 29/243.525 |
| 5,653,368 | A | * | 8/1997 | Miles et al. | 29/243.523 |
| 6,490,905 | B1 | * | 12/2002 | Campbell et al. | 72/391.8 |

FOREIGN PATENT DOCUMENTS

| | | |
|---|---|---|
| DE | 296 00 615 | 12/1996 |
| EP | 0 527 414 | 2/1993 |
| EP | 0 594 333 | 4/1994 |
| FR | 2 339 987 | 8/1977 |

* cited by examiner

*Primary Examiner*—David B. Jones
(74) *Attorney, Agent, or Firm*—Young & Thompson

(57) ABSTRACT

Electroportable apparatus for positioning nuts to be set and the setting of blind rivets whose shank ruptures includes a body of the eledtroportable type containing an electric motor, a mandrel, drive part to maintain and pull the head of the rivet and/or to pull, screw or unscrew the nut to be set, as well as a part for pre-regulating the path of the mandrel.

11 Claims, 5 Drawing Sheets

ELECTROPORTABLE DEVICE FOR PLACING CLINCH-ON NUTS OR BREAK-OFF STEM BLIND RIVETS

BACKGROUND OF THE INVENTION

The invention concerns an electroportable apparatus for setting nuts or blind rivets whose shanks rupture.

DESCRIPTION OF THE RELATED ART

At present, apparatus for setting nuts or blind rivets whose shanks ruptures rupture, are supplied by electrical cables or pneumatic cables. Along assembly lines where several people work, there is rapidly an overlapping of wires which is undesirable for working safety.

More and more, industries are oriented toward apparatus of this type, which is portable and which imparts comfort and efficiency to work. These portable apparatuses are very bulky and highly energy consumptive. They therefore have a short charge and must often be recharged.

The state of the art can be defined by the following patents.

WO95/13887: The tool for setting rivets and self-tapping screws, comprises a movable body, terminating in a head permitting holding the rivet or the self-tapping screws so as to be driven in rotation by the electrical motor with gearing and by means of the intermediate screw which is provided with a pulling device. The tool is contained in a housing of the electroportable type, and provided with a loader-distributor of screws or self-penetrating rivets.

WO96/25258: The invention relates to a self-piercing riveting device, actuated by a motor and comprising a housing held by an operator. The housing contains a motor driving a principal pinion, connected by a transmission wheel to the cam driving a riveting mechanism, this latter being well known in the field of art to which it relates. The above mechanism is installed in an independently rotatable cylinder turning directly the riveting mechanism. When the device operates, a rotative couple is first impressed on the riveting mechanism by the transmission wheel so as to clamp the jaws about a shank until the rotation couple is minimal, necessary to burst a rivet, namely, superior to that which is required to pierce a workpiece to be machined; the transmission wheel will then cease to turn to transform it into an orbital wheel for the drive pinion. The rotatable cylinder then causes to turn and move the self-piercing rivet. Boring of the workpiece takes place until the rivet is emplaced. Increased pressure on the trigger switch brakes the rotatable cylinder, driving the rotatable coupler rearwardly on the transmission wheel to shape the rivet, after which the cam, because of maintaining the braking pressure controlled by the triggering switch, gives rise to the return by 360° of arc, of the mechanism, so as to get rid of the shank that was used and to receive another.

EP-A-0 670 199: Apparatus for placing the female portion of a blind rivet is provided, with a traction rod, a motor, a first drive transmission to generate rotatable movement of the traction rod and which can be interrupted and a second drive transmission which has a drive portion and a driven portion and in which the driving portion can be moved over a path of movement and which has an empty space relative to the driven portion and a usable path.

FR-A-2.706.338: The invention relates to a riveting tool with a system for sucking up rivets, comprising a body which is connected to a lower portion and carrying an upper portion with a gripping assembly for the shank of the rivet that is hydraulically controlled, said gripping assembly being provided with a pincers mandril and a hydraulic jack being connected to a space above the upper portion of the pneumatic piston which is formed in the body of the tool, an air outlet under the pressure of a control valve opening into a space below the lower portion of the pneumatic piston which is guided in a cylindrical reinforcement of the lower portion of the tool, said control valve being fixed in an imperforate separation wall of the lower portion of the tool and being connected by means of a valve rod, freely guided in the longitudinal recess of the body, with a detent which is slidably mounted in a transverse guide.

There are known devices having less encumbrance. Thus, EP-A-0 527 414 provides an apparatus for blind rivets with a housing and a traction device having a gripping mechanism, which can be moved by an electric motor by means of a drive device. Such an apparatus for blind rivets must be actuated with increased comfort. To do this, the drive apparatus as a demultiplying ratio independent of the position of the traction device and giving rise to a permanent relationship between the electric motor and a traction device which ensures that the movement of the traction device takes place solely under the control of the electric motor.

Such an apparatus however does not give entire satisfaction.

First, there is proposed a constant demultiplication ratio all along the path of the traction device. An important drawback of this choice is that a maximum drive couple in the middle of the path cannot be targeted, which is to say at the moment at which the riveting requires the greatest coupling.

Moreover, the design of the apparatus according to EP-A-0 527 414 is very particular to the transmission system. The horizontal position of the motor is less ergonomic and the choice of a ball screw coaxial with the traction device to actuate it is a heavy and costly technical solution.

Moreover, it is essentially the relaxation of the trigger which controls the return of the traction device. This path control is different from that of the present invention and has the drawback of risking bad riveting if the operator too quickly releases the trigger or if he does not detect an anomaly such as wire drawing.

Finally, economy of electrical consumption is not optimal, because it can be, by tardy release of the trigger, that the traction path that is necessary and sufficient is exceeded.

SUMMARY OF THE INVENTION

The present invention seeks to overcome the drawbacks of the present art.

The apparatus according to the invention, for the setting of screws or blind rivets, is of the type comprising an electroportable body, containing an electric motor, a mandrel, drive means to maintain and pull on the nail or rivet and/or to pull, screw or unscrew the nut to be set.

The apparatus further comprises preadjustment means of the path of the mandrel, permitting, after the pre-regulated course of the mandrel, an automatic return.

The invention can take several embodiments disclosed hereafter.

The amplitude of the path of the mandrel is adjustable as a function of the size of the nut or rivet to be set.

Adjustment of the path of the mandrel is a distance adjustment.

The pre-adjustment means are constituted by a slider which moves a detector that is movable relative to a fixed detector.

The pre-selection of the rivet and/or of the nut to be set is carried out by a potentiometer which measures electronically the distance of the path of the mandrel.

The mechanical apparatus for setting blind rivets comprises an electric motor driving a ball screw, which drives by means of balls, a toothed wheel actuating a rack driving the riveting mechanism.

The electric motor is a coupled motor.

The drive means actuating the riveting mechanism are actuated by a hydraulic micro-central, the motor actuates the hydraulic micro-central, and energy transmission takes place by means of a hydraulic pump, which is an integral portion of the hydraulic micro-central.

The mandrel is adapted to position nuts and an electric motor is disposed on the working axis of the mandrel for screwing or unscrewing.

The trigger of the apparatus is the control means, the first pull actuating screwing of the second pull actuating pulling along a predetermined path with automatic return and upon releasing the trigger, the automatic unscrewing action for x turns of the motor and stopping said motor.

The trigger is connected by a branched distributor to a connection socket, itself connected to another socket, which is connected to the hydraulic circuit, which supplies point A and point B and on the other hand the piston, secured to the hollow mandrel, O-rings ensuring the sealing of the hydraulic assembly, a return spring for the hollow mandrel, the end of the hollow mandrel is disposed at the level of the recess, which gathers the nails when they are pulled, and that the end of the hollow mandrel is located at the level of the nose and of the pulling broach of the electrohydraulic riveter.

The trigger has two functions:

first, the trigger closes in a first instance the hydraulic circuit A and B, secondly, the same trigger starts the motor, which drives the pump, for the regulated pre-established path, and that the release of the trigger by opening the hydraulic circuit, drives the return of the piston, namely of the hollow mandrel to the rear. The electric motor is positioned substantially along the vertical axis of the electroportable body and is mounted with a freedom of movement in pivoting relative to the electroportable body.

The adjustment of the path of the mandrel is a distance adjustment.

The cycle of operation of the electroportable riveter with an adjustable path can be the following.

The motor-couple is supplied by a power circuit closed by two relays which permit the circulation of current and its inversion.

The control circuit is controlled by a sequential command or a holding contact. This control is actuated by a control trigger disposed on the body of the apparatus. The current flows then into a first branch of the control circuit. This first branch is opened by a contact which symbolizes the end of path contact. The switch then swings to supply a second branch of the control circuit which controls a relay, the power current circulates in the reverse direction, the motor-couple changes as to direction of rotation and returns the drive means to the initial position.

It will thus be understood that the trigger controls the starting of the cycle but that it does not control the return by inversion of the motor-couple. The return takes place without control, by detection when the pre-regulated course is achieved.

In this way, bad riveting is avoided because, upon the systematic execution of a certain path, the anomalies such as wire drawing will be reduced, as well as sliding by wear of a jaw or else an error of punching the sheet metal to be riveted.

According to another embodiment, the drive means actuating the riveting mechanism are actuated by a hydraulic micro-center.

The motor-couple actuates the hydraulic micro-center.

The transmission of energy takes place by means of a hydraulic pump, which is an integral part of the hydraulic micro-center.

In the embodiment in which the apparatus is adapted to set nuts, the mandrel is adapted to position these nuts and an electric motor is disposed along the working axis of the mandrel to screw or unscrew them.

The trigger of the apparatus is the control means.

The first pull actuates screwing, and, the screwing terminated, pulling continues to actuate the traction on the predetermined path with an automatic return.

Upon releasing the trigger, there is an automatic unscrewing action for x turns of the motor and stopping of said motor.

In the case of low battery, a second pull gives rise to a return to zero position.

Preferred embodiments of the invention are given hereafter.

The adjustment of the path of the mandrel is a distance adjustment. There are thus detected the extreme positions of the mandrel for biasing detectors. Other adjustment means, such as counting the number of turns of the motor or from the angular position of the toothed drive wheel, can be provided.

The adjustment of the path of the rivet whose dimensions have been selected, takes place automatically by an electronic control means.

The pre-selection of the rivet and/or of the nut to be set, is carried out manually by a cursor which moves a movable detector relative to a fixed detector.

The pre-selection of the rivet and/or of the nut to be set is carried out by a potentiometer which controls electrically the distance of the path of the mandrel.

The characteristic techniques of the motor-couple are to develop maximum power for several seconds.

The characteristics can be as follows:

couple constant: 19.4 mNm/A speed constant: 491 tr/min/V load constant: 8.45 tr/min/mNm

BRIEF DESCRIPTION OF THE DRAWINGS

The accompanying drawings are given by way of example and not limitation. They show one embodiment. They permit easy understanding of the invention.

FIG. 3 is a power circuit diagram.

FIG. 4 is a control circuit diagram.

DESCRIPTION OF THE PREFERRED EMBODIMENTS

The apparatus according to the invention for positioning nuts to be set or for setting blind rivets, is of the type comprising an electroportable body 1 containing an electric motor 2, a mandrel 3, drive means to hold and pull the head of rivets and/or to pull, screw or unscrew the nut to be set.

According to the invention, the electric motor is a motor couple 2.

The amplitude of the path of the mandrel 3 is pre-adjustable as a function of the size of the nut or rivet to be set.

Figure 1:
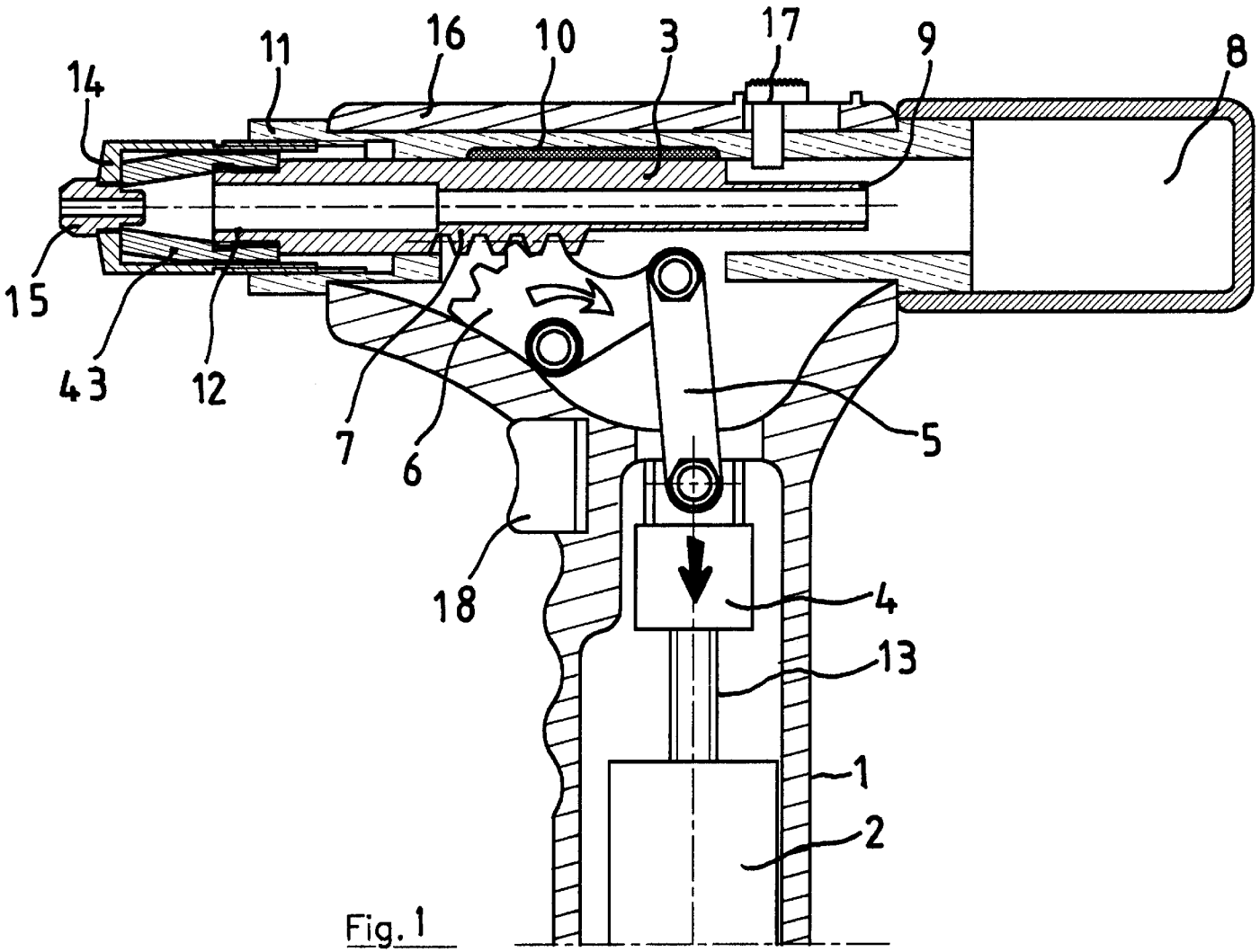
FIG. 1 is a schematic view of the apparatus for setting blind rivets, according to an electromechanical embodiment.

According to the embodiment shown in FIG. 1, in which the apparatus is a mechanical apparatus for setting blind rivets, the motor-couple 2 drives a ball screw 3, which is disposed in a ball socket 4, which drives a set of levers 5, said levers being connected to a toothed wheel 6.

According to a modification, this ball socket can be mounted on an oscillating roller structure so as to have all the elements in line. This embodiment is not shown in the figures.

Figure 6:
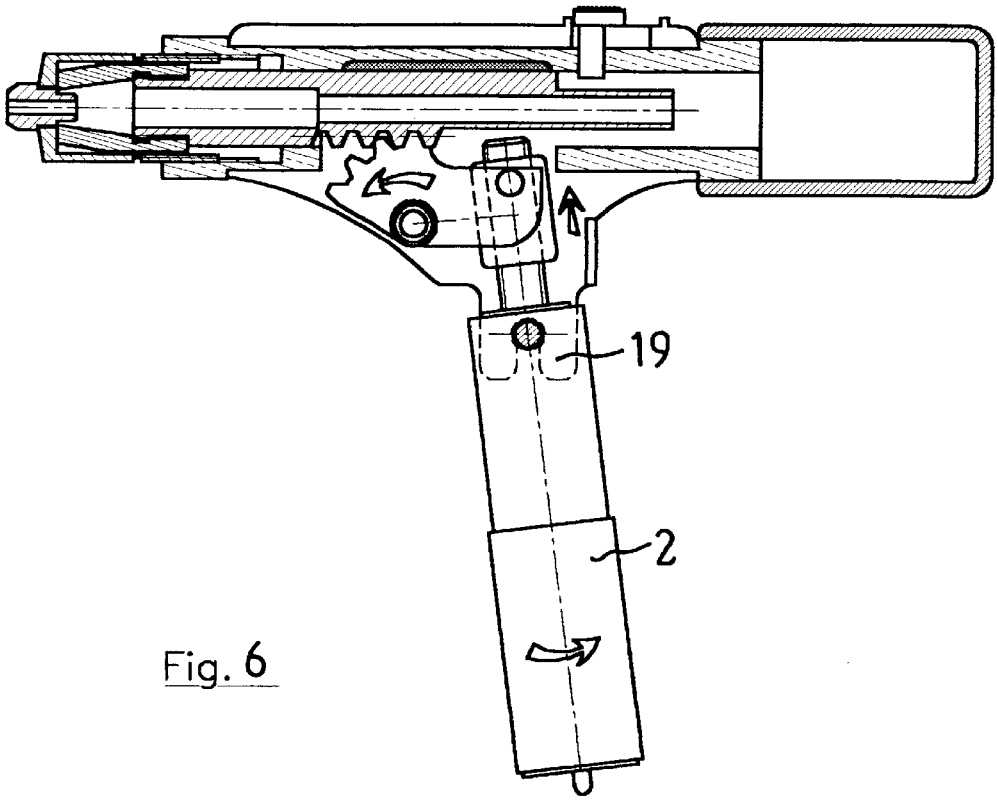
FIGS. 6 and 7 show a particular embodiment of the motor mounting.
Figure 7:
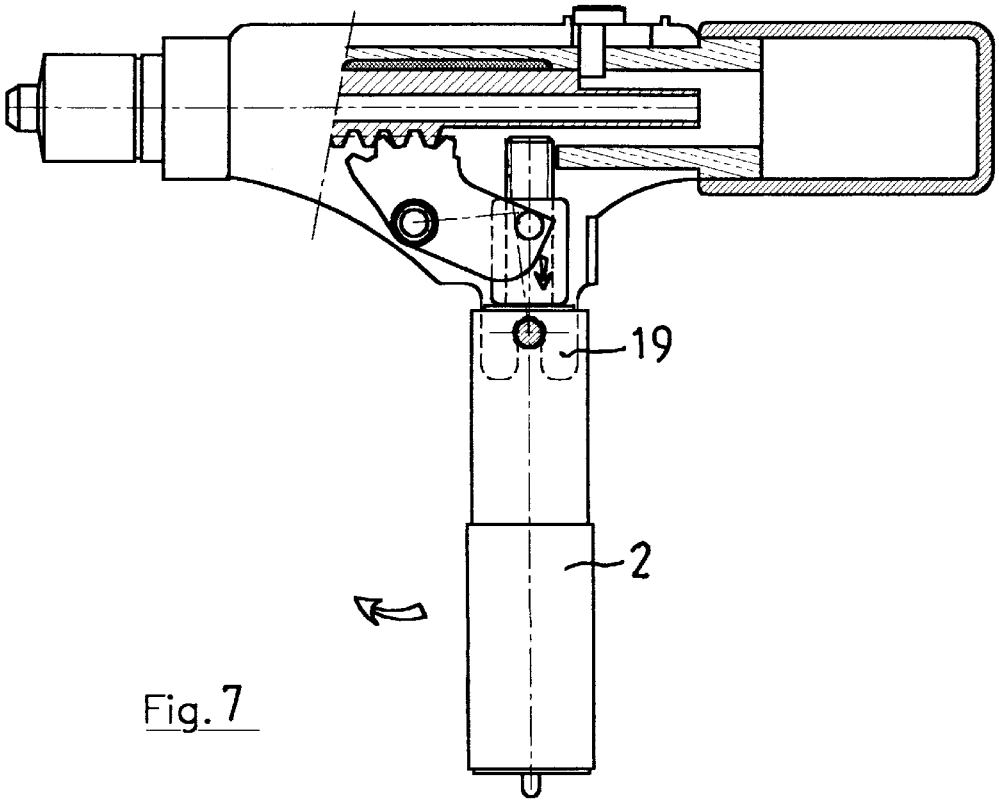

In another embodiment, shown in FIGS. 6 and 7, the motor assembly 2 is mounted so as to permit freedom of pivoting relative to the electroportable body 1. This freedom of movement is integrated into the kinematics of mounting and descent of the ball socket 4. This design is very effective and less costly for production.

Thus, the motor 2 can be pivotally mounted by the bias of a fork 19 without other necessary articulations.

This toothed wheel 6 engages a rack 7 which is an integral part of the body of mandrel 3. The mandrel 3 is a hollow mandrel, which permits recovering the heads of the rivets in the recess 8 provided for this purpose along the axis of the end 9 of the hollow mandrel 3.

The hollow mandrel 3 is facilitated in its movement by a sliding pad 10 disposed about the head 11, which holds the mechanism together.

The end 12 of the hollow mandrel 3 comprises a jaw-carrying cone 43, the jaws are not shown, nor the pusher and the spring. The nose 14 secured to the head 11 carries the traction broach 15. The assembly of the mechanism is maintained by a frame 16. On this frame 16 is disposed a slide 17. The pre-selection of the rivet and/or the nut to be set is carried out manually by the slide 17, which moves a movable detector relative to a fixed detector. The fixed and movable detectors are not shown in the drawings.

According to another embodiment, the pre-selection of the nut and/or the rivet to be set is carried out by a potentiometer which electronically controls the course of the mandrel 3.

The trigger 18 actuates the motor-couple 2.

Figure 2:
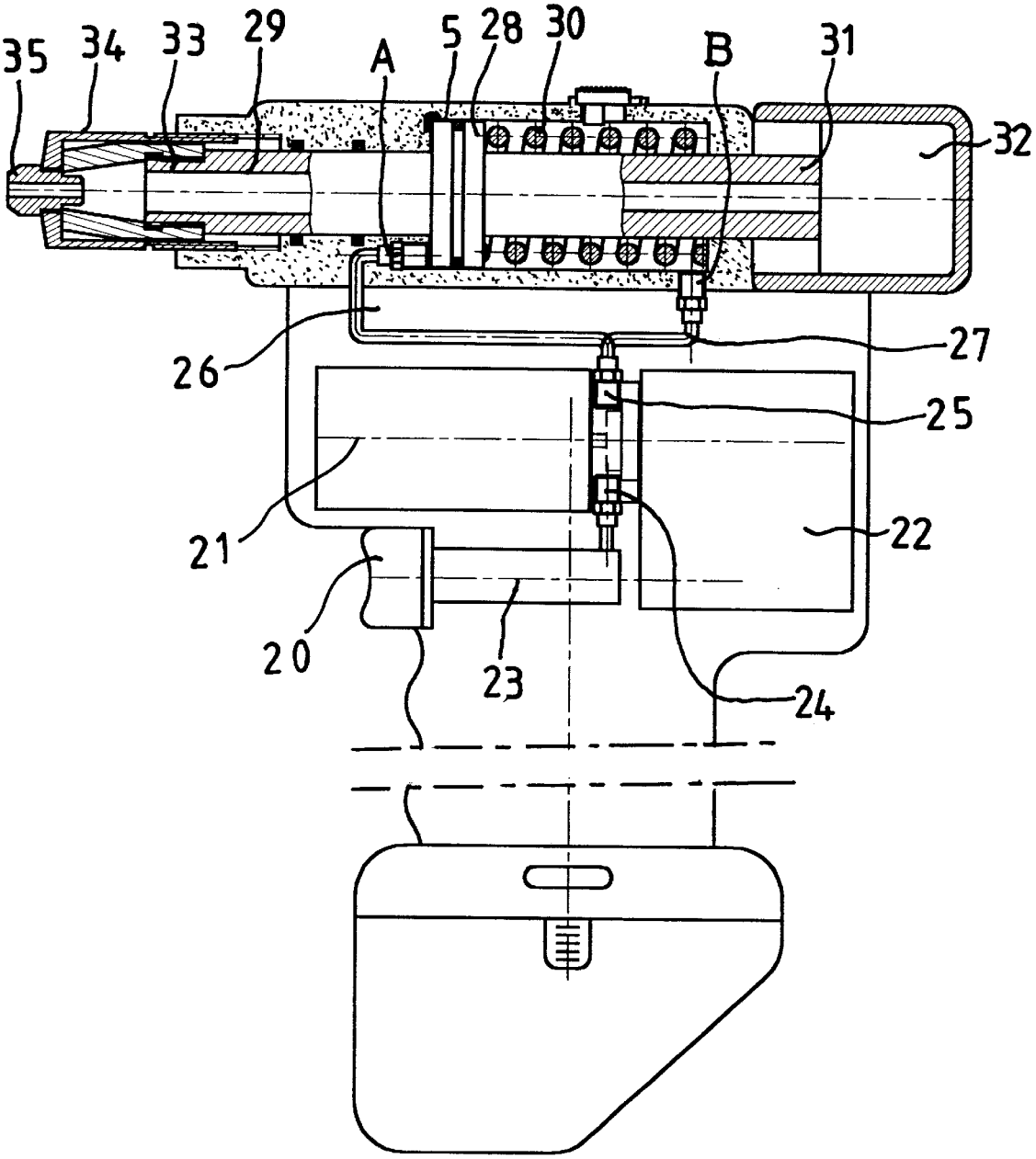
FIG. 2 is a schematic view of all of the apparatus for setting blind rivets, according to an electrohydraulic embodiment.

FIG. 2 shows an electroportable apparatus for positioning and setting blind rivets whose shank ruptures, in an electrohydraulic version shown in FIG. 2.

In FIG. 2, there is seen an actuating trigger 20, a motor-couple 21, which actuates the pump 22. The trigger is connected to a distributor connected to a connection ferrule 24, itself connected to another ferrule 25, which is connected to the hydraulic circuit 26 and 27, which supplies a point A and a point B, on opposite sides of the piston 28, secured to the hollow mandrel 29. O-rings are shown and ensure the sealing of the hydraulic assembly. A return spring 30 ensures return of the hollow mandrel 29. The end 31 of the hollow mandrel is disposed at the level of the recess 32, which collects nails when they are pulled.

The end 33 of the hollow mandrel is located at the level of the nose 34 and of the pulling broach 35, of the electro-hydraulic riveter.

The trigger 20 has two functions:

first, the trigger 20 closes in the first instance the hydraulic circuit A and B.

secondly, the same trigger starts the motor-couple 21, which drives the pump 22, for the regulated pre-established path.

Release of the trigger 20, by opening the hydraulic circuit, drives the return of the piston, namely of the hollow mandrel rearwardly.

Figure 3:
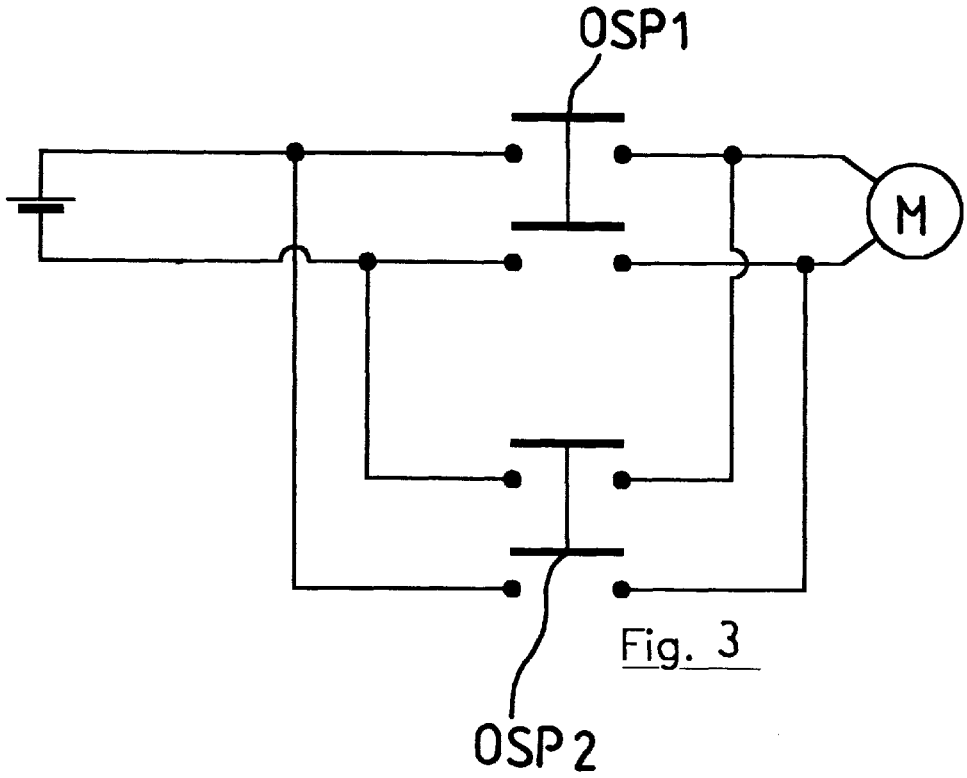
FIGS. 3 and 4 are circuit diagrams for the control of the power circuit.
Figure 4:
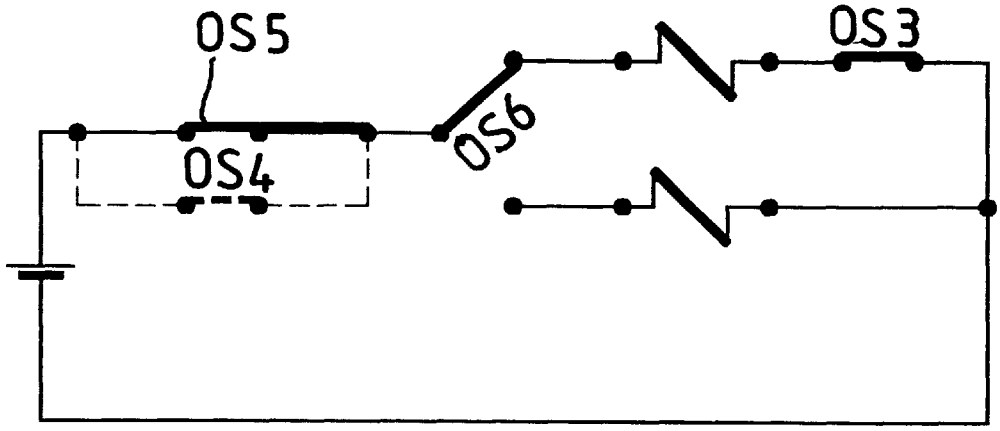

FIG. 3 shows the power circuit in the case of the electromechanical apparatus, and FIG. 4 shows the control circuit.

The motor is applied by the power circuit represented in FIG. 3 closed by the relays OSP1, OSP2 which permit the flow of current and its inversion. The control circuit shown in FIG. 4 is controlled by a sequential command OS4 or a maintained contact OS5. This control is embodied in the trigger 20 or 18 for control of the machine. The current then flows through the first branch of the control circuit, the relay OSP1 is closed, but the relay OSP2 is open, the direction flow is direct.

This branch is opened by the contact OS3, which symbolizes the end of path contact. The switch OS6 swings then to supply the branch 2 of the control circuit which adjusts the relay OSP1 open and the relay OSP2 closed. The power then flows in the opposite direction. The motor M changes its direction of rotation and returns the assembly of the mobile device to its initial position. If it is desired to interrupt the operation in the middle, a second pull on the trigger returns the apparatus to the zero position.

Figure 5:
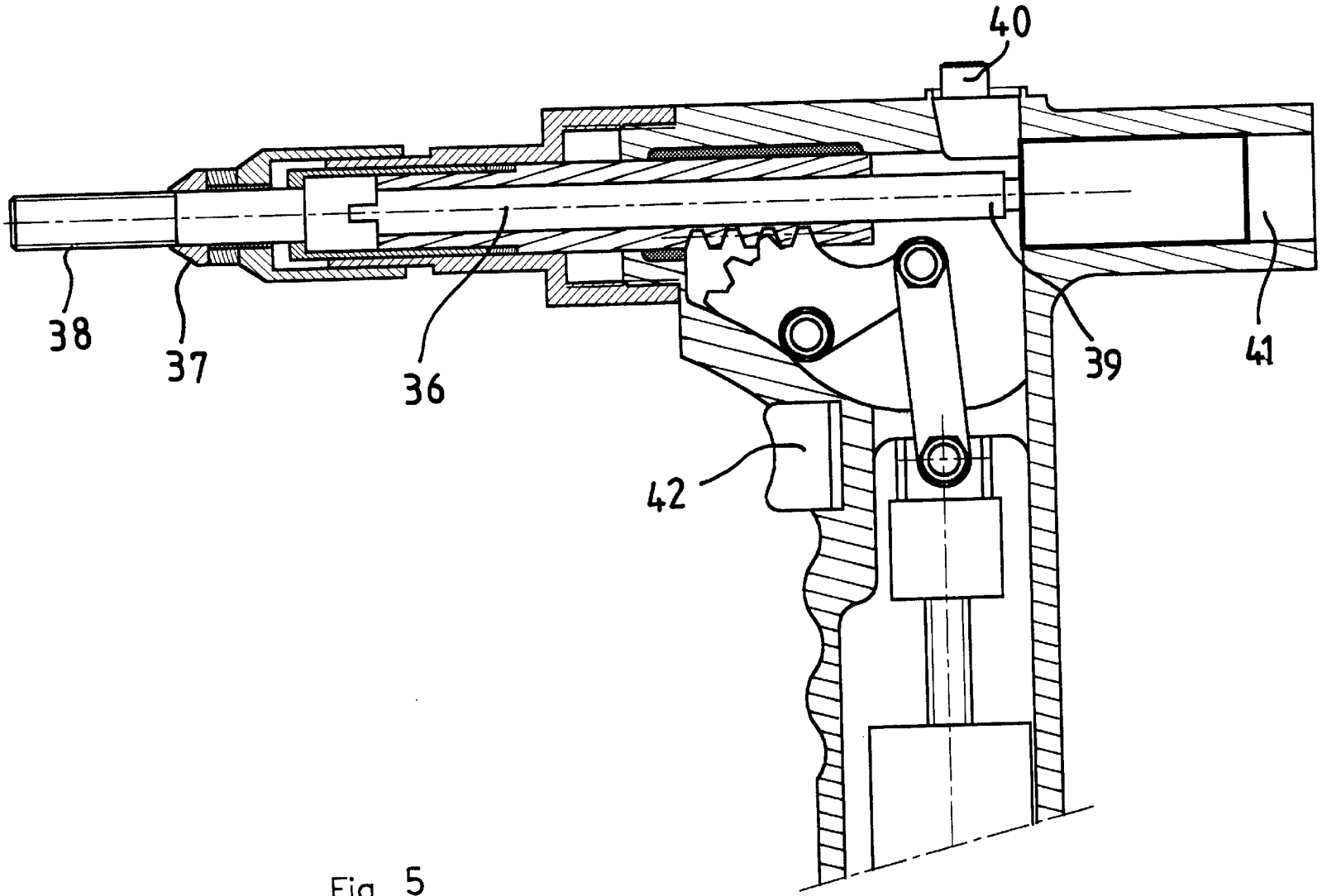
FIG. 5 is a schematic view of the apparatus for positioning nuts to be set.

The embodiment shown in FIG. 5 is an electroportable apparatus for positioning nuts to be set. In this embodiment, there are seen all the elements already described in the different figures, if it is only the mandrel 36 that is imperforate, because there is no recovery of the heads of the rivets, but at the level of the nose 37, the ferrule 38 is screw-threaded to permit the emplacement of the nuts, and finally, at the end 39 of the mandrel 36, is disclosed an electric motor 41 which screws and unscrews, thereby permitting the screw-threaded ferrule to screw or unscrew exactly the nut to be set. The actuation is triggered by the trigger 42.

Of course, a cursor 40 permits regulating exactly the path of the mandrel, which path must be very precise so as not to break the thread of the nut to be set.

No matter what the form of the pre-adjustment means of the path of the mandrel 3, 36, there is carried out an optimized path according to the size of the rivet or of the nut, to ensure good securement without breaking but also so as not to generate an overconsumption of electrical energy by prolonging the path beyond what is necessary.

The pre-adjustment means from the form of the cursor 40 or 17 coact with detectors of which one is movable, permitting these advantages.

Reference

1. electroportable body
2. electric motor
3. mandrel
4. ball socket
5. set of levers
6. toothed wheel
7. rack
8. recess
9. end of hollow mandrel 3
10. slide pad
11. head
12. end of hollow mandrel 3
13. ball screw
14. nose
15. pulling broach
16. frame
17. cursor
18. trigger
19. fork
20. actuating trigger
21. motor
22. pump
23. distributor
24. connecting ferrule
25. ferrule
26–27. hydraulic circuit
28. piston
29. hollow mandrel
30. return spring
31. end of hollow mandrel
32. recess
33. end of hollow mandrel
34. nose
35. pulling broach
36. mandrel
37. nose
38. ferrule
39. end of mandrel
40. cursor
41. electric motor for screwing and unscrewing
42. trigger
43. jaw-carrying cone

What is claimed is:

1. Apparatus for positioning nuts to be set and for setting blind rivets, comprising:

an electroportable body (1) containing an electric motor (2), a mandrel (3), drive means to i) maintain and to pull a head of the rivet and ii) to pull, screw and unscrew a nut to be set, means for pre-adjusting a path of the mandrel (3, 29, 36) permitting, after a pre-regulated course of the mandrel (3, 29, 36), an automatic return, and an electronic control means to automatically make an adjustment of a path for a rivet whose dimensions have been selected, wherein, the electric motor drives a ball screw (13) connected via levers (5) to a toothed wheel (6) actuating a rack (7) driving a riveting mechanism.

2. Apparatus according to claim 1, characterized by the fact that the adjustment of the path of the mandrel (3, 29, 36) is a distance adjustment.

3. Apparatus according to claim 2, characterized by the fact that the pre-adjustment means are constituted by a cursor (17, 40) which moves a movable detector relative to a fixed detector.

4. Apparatus according to claim 1, characterized by the fact that the pre-selection of the rivet and/or of the nut to be set is carried out by a potentiometer which electrically controls the distance of the path of the mandrel.

5. Apparatus according to claim 1, characterized by the fact that the electric motor (2) is a motor couple.

6. Apparatus according to claim 1, characterized by the fact that the drive means actuating the riveting mechanism are actuated by a hydraulic microcenter, the motor (21) actuates the hydraulic microcenter, and the transmission of energy takes place by means of a hydraulic pump (22) which is an integral part of the hydraulic microcenter.

7. Apparatus according to claim 1, characterized by the fact that the mandrel (3, 29, 36) is adapted to position the nut and an electric motor (41) is disposed along the working axis of the mandrel to screw or unscrew.

8. Apparatus according to claim 7, characterized by the fact that a trigger (42) of the apparatus is the control means, a first pull actuates screwing and a second pull actuates traction over a predetermined course with automatic return and a release of the trigger (42), an automatic unscrewing action for x turns of the motor and stopping the motor.

9. Apparatus according to claim 7, characterized by the fact that a trigger is connected to a distributor (23) connected to a connecting ferrule (24), itself connected to another ferrule (25), which is connected to the hydraulic circuit (26) and (27), which supplies a point A and a point B, on opposite sides of the piston (28), secured to the hollow mandrel (29), O-rings ensuring sealing of the hydraulic assembly, a return spring for the hollow mandrel (29), the end 31 of the hollow mandrel is disposed at the level of the recess (32), which collects items that are pulled, and that the end (33) of the hollow mandrel is located at a level of the nose (34) and of a pulling broach (35).

10. Apparatus according to claim 9, characterized by the fact that the trigger (20) has two functions:

first, the trigger (20) closes in the first instance the hydraulic circuit A and B, secondly, the same trigger starts the motor (21), which drives a pump (22), for the preliminarily adjusted path, and that the release of the trigger (20) by opening the hydraulic circuit, gives rise to the return of the piston, of the hollow mandrel, rearwardly.

11. Apparatus according to claim 1, characterized by the fact that the electric motor (2) is positioned substantially along a vertical axis of the electroportable body (1) and is mounted with freedom of pivotal movement relative to the electroportable body (1).

* * * * *